US005793177A

United States Patent [19]

Chia

[11] Patent Number: 5,793,177

[45] Date of Patent: Aug. 11, 1998

[54] ADAPTABLE MEDIA MOTOR FEED SYSTEM FOR PRINTING MECHANISMS

[75] Inventor: Kay Boon Chia, Singapore, Singapore

[73] Assignee: Hewlett-Packard Company, Palo Alto, Calif.

[21] Appl. No.: 526,735

[22] Filed: Sep. 11, 1995

[51] Int. Cl.[6] ..... G05B 19/40

[52] U.S. Cl. ..... 318/685

[58] Field of Search ..... 318/685, 802, 318/803, 804, 805, 806, 807, 808, 809, 810, 811, 812, 813, 814, 815, 772, 774, 798, 799; 388/801; 271/202, 270

[56] References Cited

U.S. PATENT DOCUMENTS

| | | | |
|---|---|---|---|
| 4,609,868 | 9/1986 | Ferrari . | |
| 4,728,963 | 3/1988 | Rasmussen et al. | 346/25 |
| 4,808,019 | 2/1989 | Olson et al. | 400/605 |
| 4,851,755 | 7/1989 | Fincher . | |
| 4,990,011 | 2/1991 | Underwood et al. | 400/636 |
| 5,152,622 | 10/1992 | Rasmussen et al. | 400/579 |
| 5,226,743 | 7/1993 | Jackson et al. | 400/625 |
| 5,269,506 | 12/1993 | Olson et al. | 271/121 |
| 5,299,875 | 4/1994 | Hock et al. | 400/625 |
| 5,312,196 | 5/1994 | Hock et al. | 400/624 |
| 5,314,566 | 5/1994 | Gallagher et al. | 156/442.2 |
| 5,320,436 | 6/1994 | Hock et al. | 400/283 |
| 5,326,090 | 7/1994 | Hock et al. | 271/162 |
| 5,362,038 | 11/1994 | Giles et al. | 271/10 |

FOREIGN PATENT DOCUMENTS

| | | |
|---|---|---|
| 61-106347 | 5/1986 | Japan . |
| 63-212631 | 9/1988 | Japan . |
| 4275097 | 9/1992 | Japan . |
| 6044595 | 2/1994 | Japan . |

OTHER PUBLICATIONS

Hewlett-Packard Patent Application S/N 07/887,517; Filed May 19, 1992; "Portable Printer And Sheet Feeder;" Abandoned.

*Primary Examiner*—William M. Shoop, Jr.
*Assistant Examiner*—Kim Lockett

[57] ABSTRACT

This invention relates to printing mechanisms, particularly those that use stepper motors to advance paper through the mechanisms. The invention also relates to a method of advancing paper through a printing mechanism. The method involves an iterative sequence for controlling a variable speed motor. Before advancing the paper through the printing mechanism with the motor set to run at an initial speed, a sensor detects whether the motor is able to advance the paper. If the motor is unable to advance the paper, the speed of the motor is varied according to the iterative sequence until the paper is able to advance through the printing mechanism. The invention also relates to a printing mechanism that incorporates the use of such an iterative sequence.

17 Claims, 8 Drawing Sheets

ADAPTABLE MEDIA MOTOR FEED SYSTEM FOR PRINTING MECHANISMS

FIELD OF INVENTION

This invention relates to printing mechanisms and relates particularly, but not exclusively, to those that use stepper motors to advance printable media through the mechanism. The invention also relates to a method of advancing printable media through a printing mechanism.

BACKGROUND

A variety of different printing mechanisms incrementally advance print media through the mechanism to receive an image. These print mechanisms include, for example, electrophotographic ("laser") and inkjet printers, plotters, facsimile machines, cameras, and the like, which may be used in business, industry, home, or other environments. For the purposes of illustration, the term "printer" will be used herein, in the embodiment of an inkjet printer to explain the concepts of this invention. While a variety of different print media may be used, such as paper, transparencies, foils, fabric, card-stock and the like, for convenience, the term "paper" is used herein for convenience.

Motors, such as stepper motors, have been used to advance paper through the paper feeder mechanism of printing mechanisms, such as ink-jet printers. In these earlier printing mechanisms, the motors operate at a relatively constant rotational speed for the entire operational life of the printing mechanism.

In such motors, the higher the rotational speed ("slew speed") at which the motor is set to operate, the faster the paper is able to be fed through the paper feeder mechanism of the printing mechanism. There is, however, an upper limit to the speed at which the motor is able to advance the paper through the printing mechanism. The torque produced by a stepper motor varies inversely with the rotational speed of the axle of the motor, so when stepper motors operate at higher rotational speeds, the torque output is lower. Hence, each stepper motor is characterized by an optimum rotational speed, above which the motor is more likely to stall when it cannot generate sufficient torque to advance the paper. However, these earlier printing mechanisms are generally not set to operate within the range of this optimum rotational speed, even when the printing mechanisms are new, because the printing mechanisms may be unable to maintain such high performance for the life-span of the printing mechanism. This is due to the fact that as a stepper motor ages with use, typically the amount of torque produced by the motor at a particular rotational speed gradually decreases with time.

In anticipation of the inevitable decrease in motor performance, the motors in these earlier printing mechanisms have been set to operate at relatively constant rotational speeds that are well below the optimum capability of the new motors. Setting the new motors to operate well below their optimum rotational speed ensures that the motors will continue to provide adequate torque to advance the paper, even when the motors are older. Thus, in these earlier printing mechanisms, the optimum capability of the new motors are generally not utilized fully.

Furthermore, these earlier printing mechanisms are often designed with more powerful motors than are actually required, so that the motors, set to operate at a constant intermediate speed, will be able to provide adequate torque over a longer operational life. Unfortunately, an increase in the power capacity of a motor tends to be associated with increases in size, weight and cost of the product. Compactness of design and portability are therefore sacrificed to increase the longevity of the printing mechanisms. The accompanying increase in the power consumption of the motor is also a disadvantage especially in portable printing mechanisms which are battery powered.

SUMMARY OF THE INVENTION

According to one aspect of the present invention, there is provided a method of advancing printable media through a printing mechanism using a variable speed motor. The method includes the steps of attempting to advance the media through the printing mechanism with the motor set to run at an initial speed. In a detecting step, it is detected whether the motor is able to advance the media through the printing mechanism. Upon detecting that the motor is unable to advance the media through the printing mechanism with the motor set at the initial speed, repeating the two steps of (i) varying the speed of the motor to run at a different speed, and (ii) the step of detection until the speed is varied to a speed at which the motor is able to advance the media through the printing mechanism.

In an illustrated embodiment, the different speed may be slower than the initial speed of the motor. Alternatively, the different speed may be faster than the initial speed of the motor. Preferably, however, the initial speed is proximate the highest speed at which the motor, when it is new, is able to consistently advance media through the printing mechanism without stalling. Preferably, upon initially detecting that the motor is unable to advance the media through the printing mechanism and before repeating the two steps, there is a step of lowering the speed of the motor to a low speed, below the different speed, at which low speed the motor is certain to be able to advance the media through the printing mechanism.

Preferably, before the step of detection, there is the step of running the motor for a limited time period to provide an opportunity for any media to be advanced through the printing mechanism. Preferably, each time the speed of the motor is varied, the speed decreases each time by a constant interval of speed. Preferably, the motor is a stepper motor, and the speed of the motor is varied by a micro-processor.

According to another aspect of the invention, there is provided a printing mechanism having a variable speed motor adapted to advance printable media through the printing mechanism. The printing mechanism includes a media sensor for detecting whether the media is advancing through the printing mechanism. The mechanism also includes a motor speed controller adapted to vary the speed of the motor in response to an indication from the media sensor. Upon receiving indication from the media sensor that the motor is unable to advance the media through the printing mechanism when the motor is set at a certain speed, the motor speed controller is able to vary the speed of the motor to a speed at which the motor is able to advance the media through the printing mechanism.

In the illustrated embodiment, preferably the motor speed controller is able to repeatedly vary the speed of the motor until the media sensor detects that the speed of the motor has been varied to a speed at which the motor is able to advance the media through the printing mechanism. Preferably, the media sensor comprises an optical-mechanical mechanism which, upon the mechanism engaging with the media, is able to indicate to the motor speed controller that the media is able to advance through the printing mechanism. Preferably, the motor speed controller comprises a microprocessor.

An object of this invention is to optimize the performance of a printing mechanism that uses a variable speed motor to advance the printable media through the printing mechanism, and/or to allow the printing mechanism to function as effectively with a less powerful motor.

BRIEF DESCRIPTION OF THE DRAWINGS

In order that the invention might be more fully understood, a preferred embodiment of the invention will be described, by way of example only, with reference to the accompanying drawings, in which:

(FIG. 8 is not drawn to scale).

DETAILED DESCRIPTION OF A PREFERRED EMBODIMENT

Figure 1:
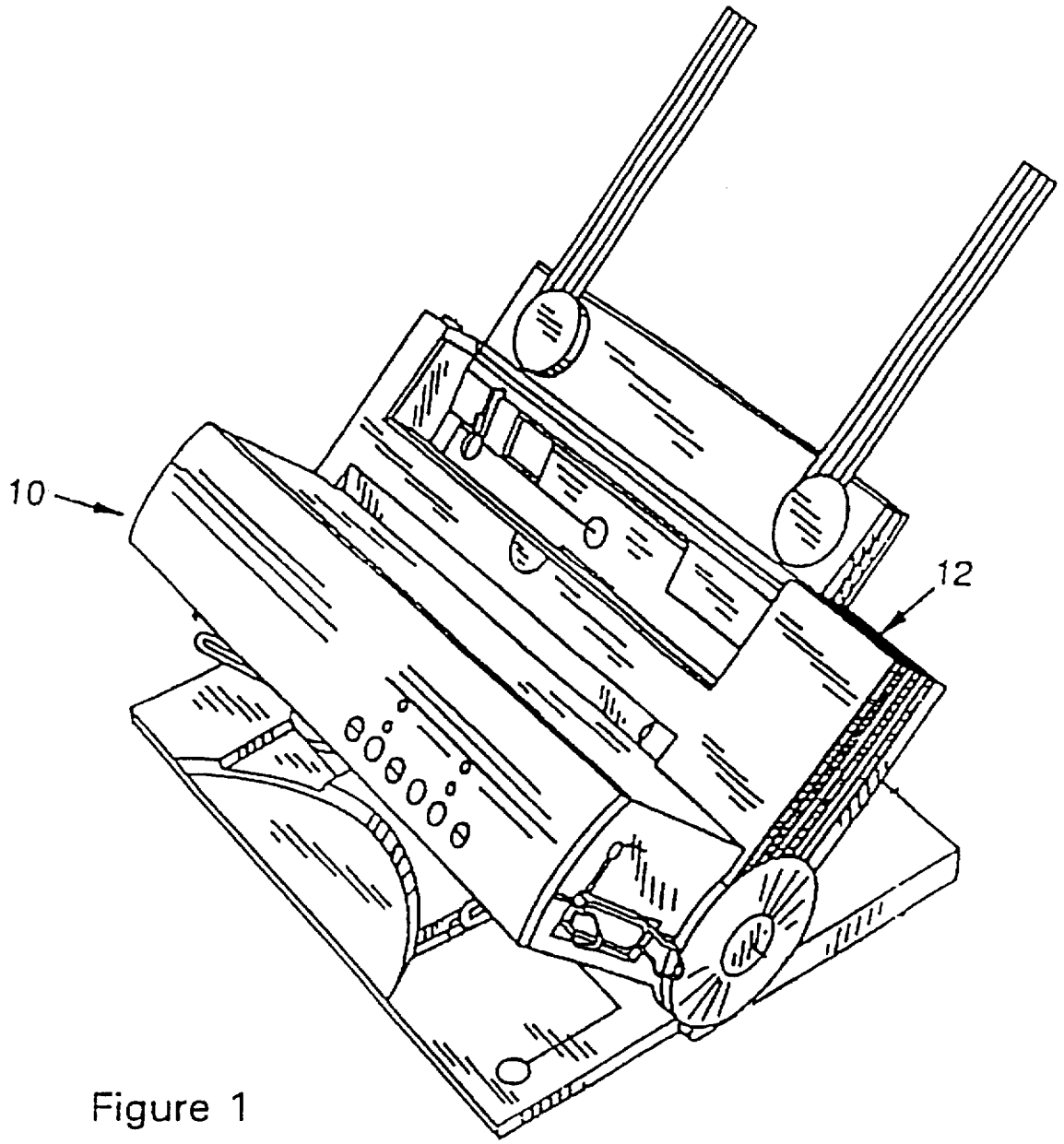
FIG. 1 is a front perspective view illustrating a printer and sheet feeder in an operational mode.
Figure 2:
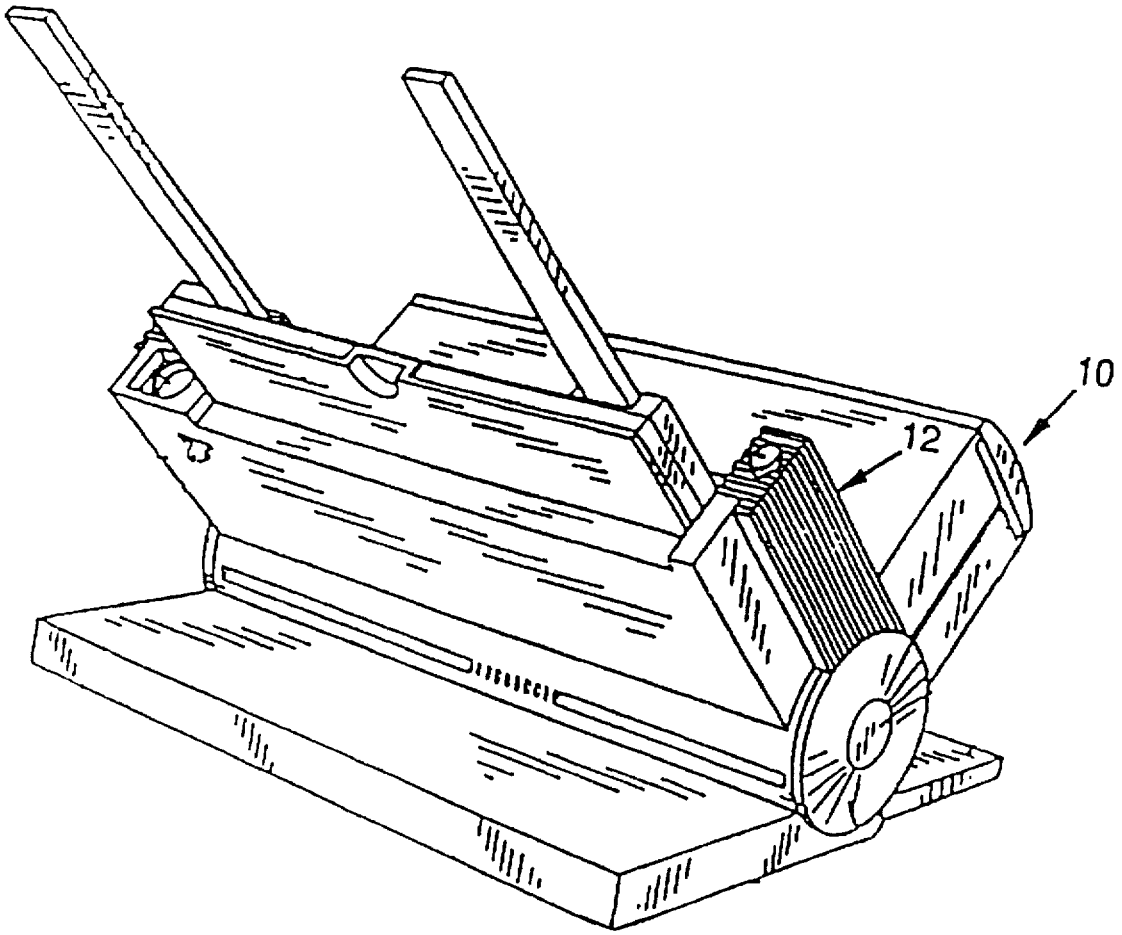
FIG. 2 is a rear perspective view illustrating the printer and sheet feeder of FIG. 1.
Figure 3:
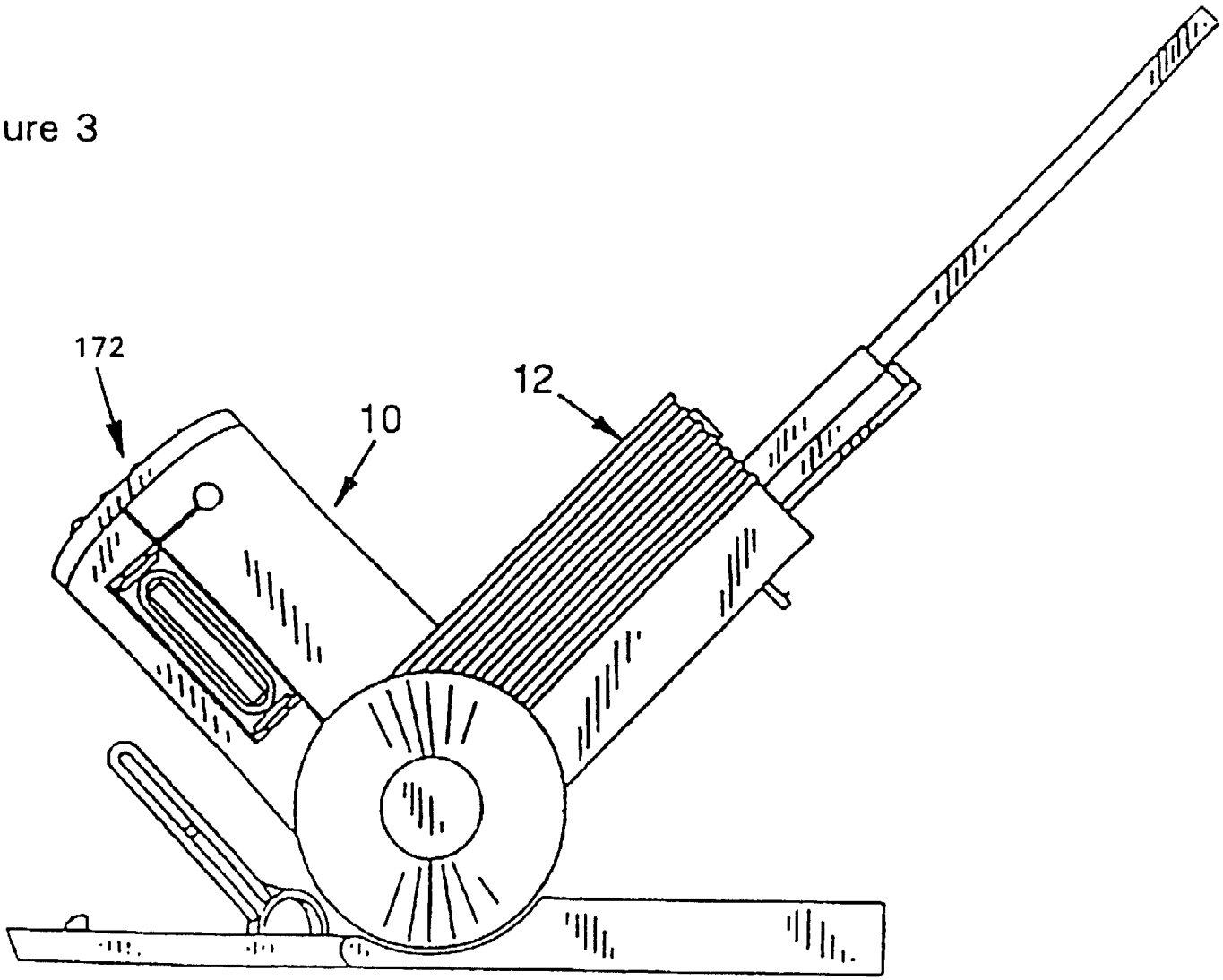
FIG. 3 is a right side view of the printer and sheet feeder in the operational mode of FIGS. 1 and 2.

Referring to the drawings, FIGS. 1, 2 and 3 are illustrations of an embodiment of a printing mechanism, here shown as an inkjet printer 10, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience, the concepts of the present invention are illustrated in the environment of an inkjet printer 10.

The print media may be any type of suitable sheet material, such as paper, card-stock, transparencies, mylar, and the like, but for convenience, the illustrated embodiment is described using paper as the print media.

Figure 4:
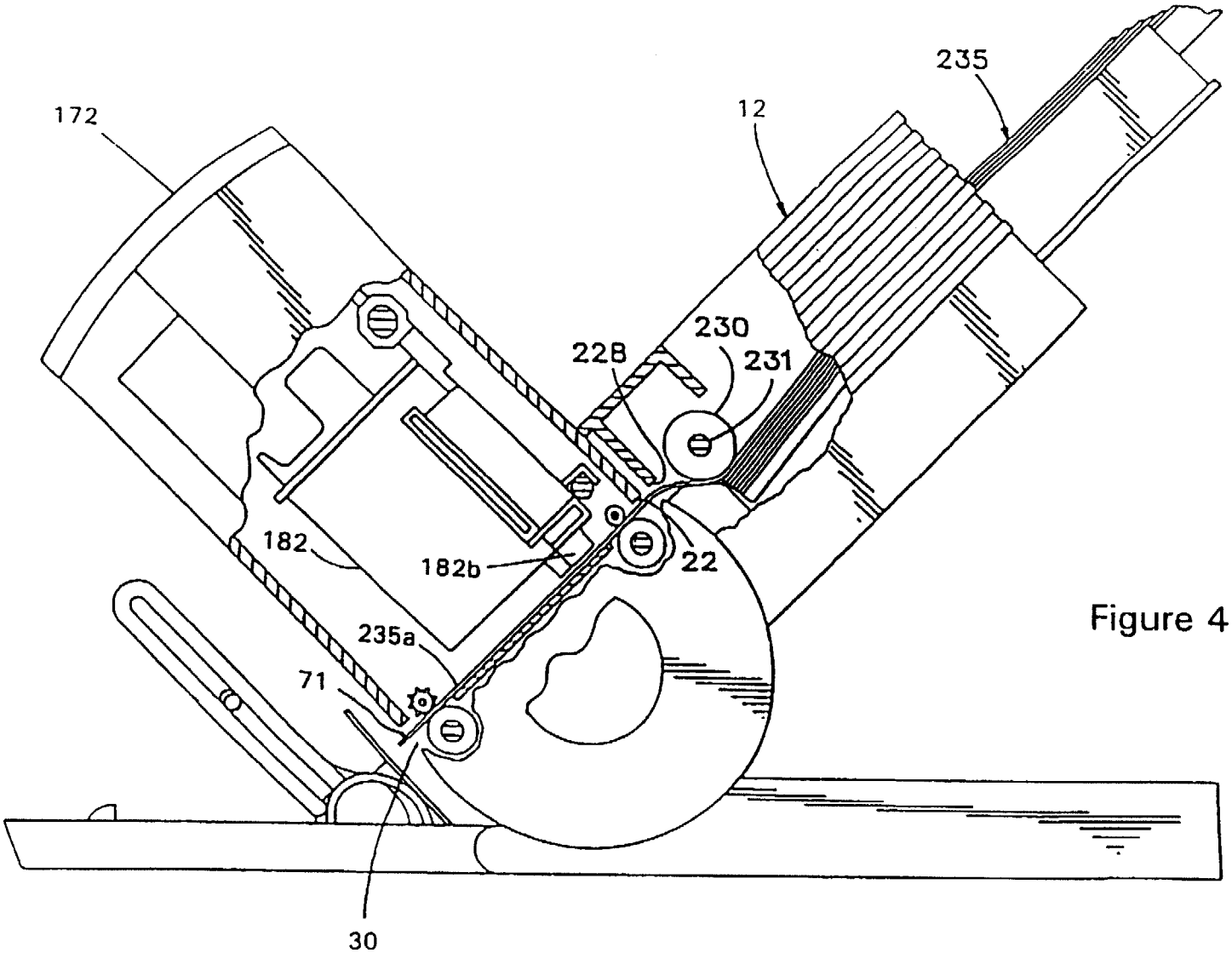
FIG. 4 is a view similar to FIG. 3 with portions broken away to illustrate the paper feed path of the paper feeder mechanism.
Figure 6:
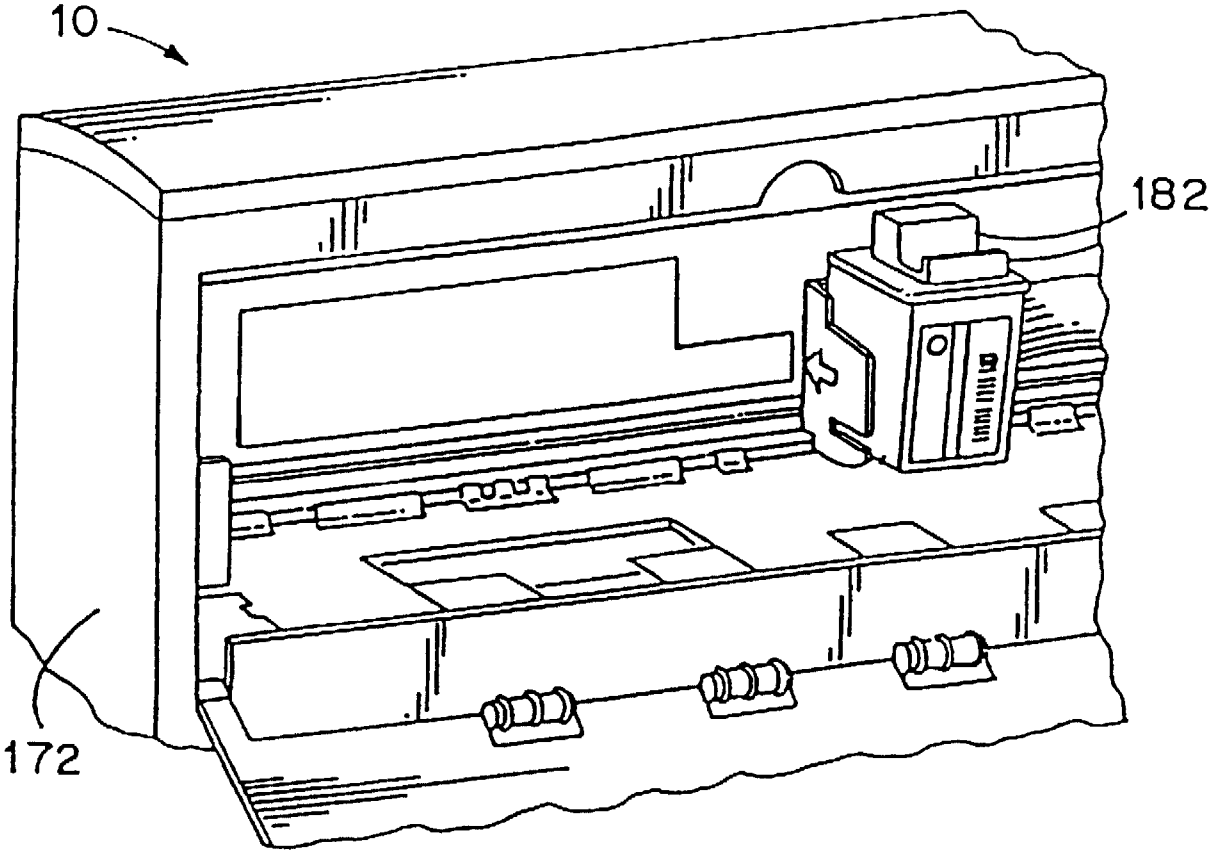
FIG. 6 is a partial perspective view of the printer of FIG. 1 with an access door being opened.

The printer 10 includes a casing 172 which is best seen in FIGS. 4 and 6. The casing 172 houses a mechanical printer structure, such as a carriage assembly (not visible) which reciprocates along a guide rod (also not shown) to carry one or more inkjet printhead cartridges 182, such as cartridge or "pen". The carriage assembly is driven by a carriage motor 80. The cartridge 182 emits ink droplets through an inkjet printhead **182*b*** onto the paper as the paper passes beneath the reciprocating cartridge. Typically, the cartridge moves laterally to print a single swath across the paper, the paper advances, another lateral swath is printed, and so forth until an entire printed sheet emerges from the printer.

Figure 7:
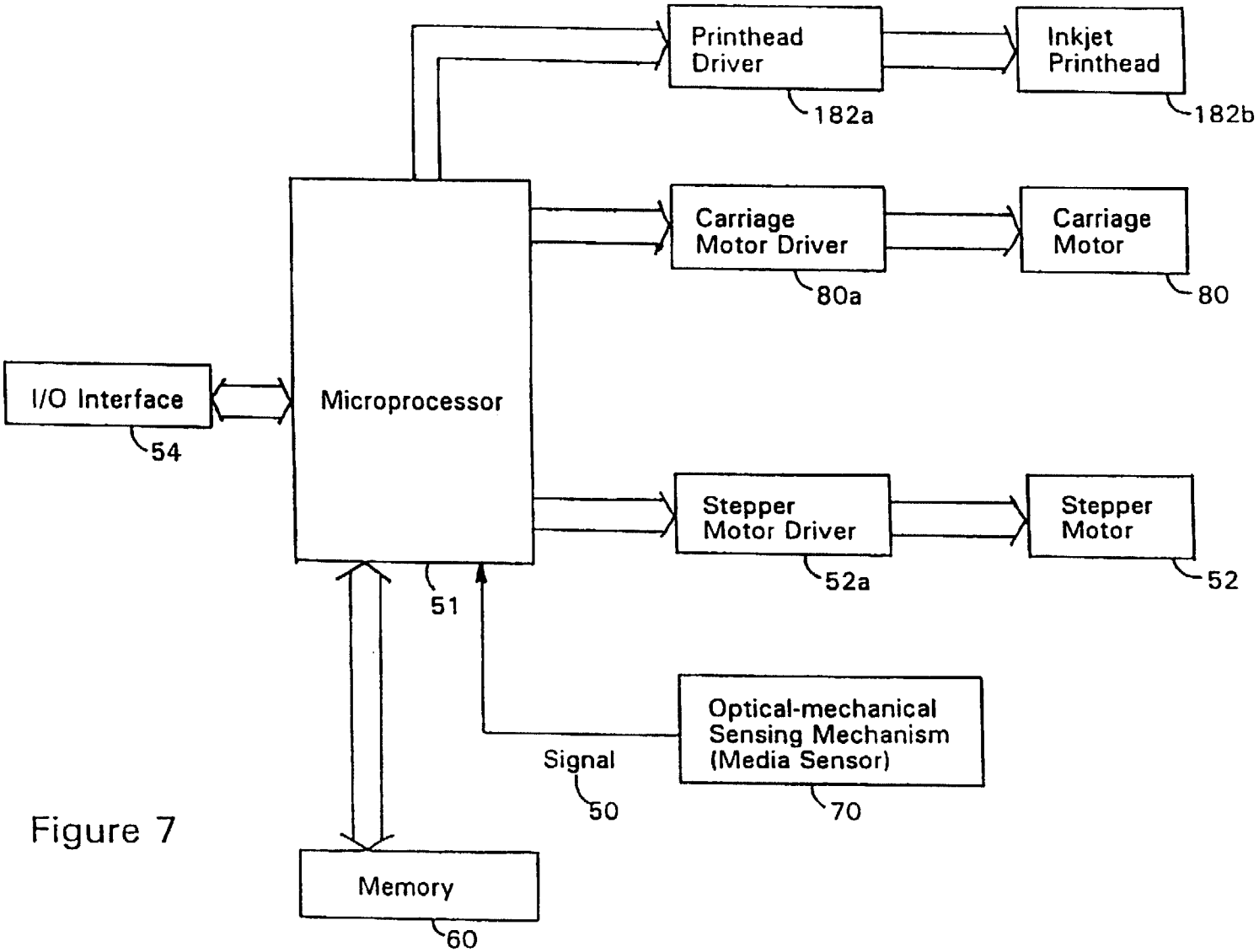
FIG. 7 is a block diagram illustrating various components found in the printer of FIG. 1.

The casing 172 also houses a paper-handling system which, in the present embodiment, is in the form of a paper sheet feeder 12, as well as an electronic circuits that control the printer 10. The electronic circuitry contains a microprocessor 51 that influences the operation of the printer. A user is able to alter parameters that are used by the microprocessor 51 by entering information and selections through an input/output (I/O) interface 54. Referring to FIG. 7, signals from the microprocessor are directed to drivers which in turn control the operation of various components of the printer 10. In particular, a printhead driver **182*a* is used to drive the inkjet printhead 182*b*. A carriage motor driver 80*a* is used to drive a carriage motor 80. A stepper motor driver 52*a* is used to drive a stepper motor 52**.

The printer 10 may be connected to a computer (not shown) by a cable, and it is typically the computer that instructs the printer 10 to print an image on a sheet of media, such as paper 235 of which an uppermost sheet of paper **235*a* will be the first to be drawn into the printer 10**.

The printer 10 comprises the sheet feeder 12 illustrated in FIG. 3. Referring to FIG. 4, a stack of paper 235 is loaded into the sheet feeder 12. The leading edge of the upper sheet of paper **235*a* from the stack 235 is positioned beneath a pinch roller 230. The pinch roller rotates about shaft 231**.

Referring to FIG. 7, a variable speed motor is contained within the printer 10. In the embodiment, the variable speed motor is in the form of the stepper motor 52, although it is conceivable that the invention may be adapted for use with other variable speed motors.

Figure 5:
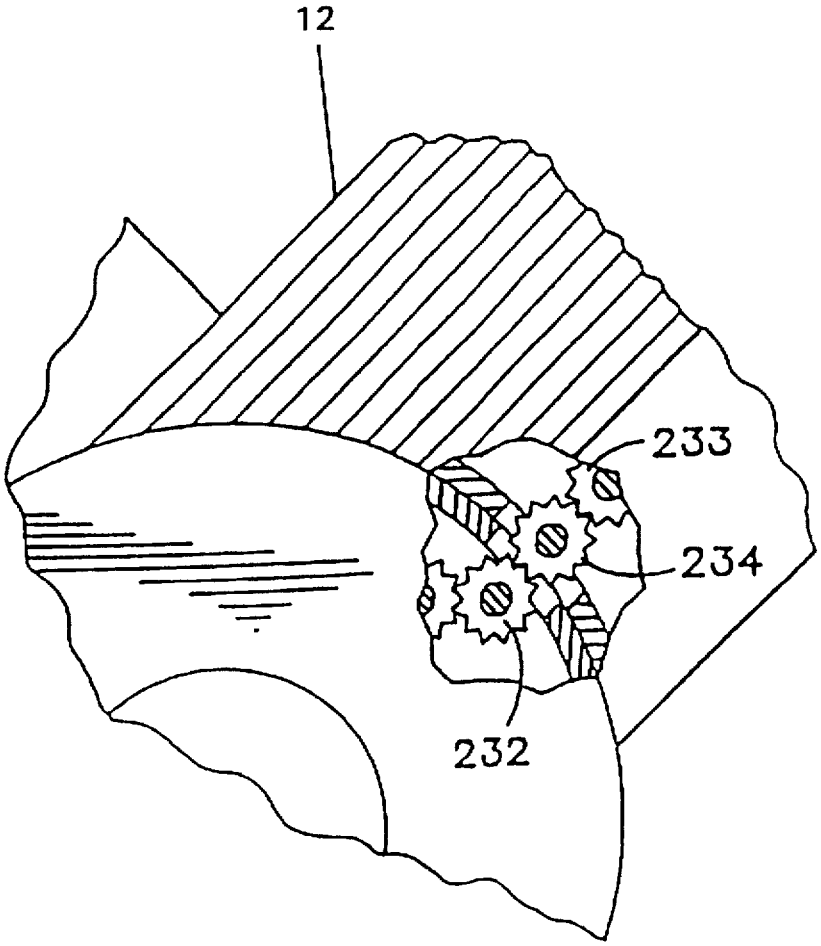
FIG. 5 is a partial view of the printer and sheet feeder of FIG. 4 with different portions broken away to illustrate the linkage between the paper feeder motor (stepper motor) in the printer and the paper feed mechanisms in the sheet feeder.

Referring to FIG. 5, the stepper motor 52 drives a gear 232 which engages with a corresponding gear 234 in the sheet feeder 12. The corresponding gear 234 is connected by a conventional gear train 233 (partially visible) to the shaft 231 for driving the pinch roller 230. The stepper motor 52 is driven in accordance with the present embodiment, to be further described, in order to advance paper 235 from the sheet feeder 12, one sheet at a time, through the printer 10.

In order to advance paper through the printer 10, the uppermost sheet **235*a* in the stack of paper 235 is grabbed by the pinch roller 230. The paper is advanced past slots 228, 22, and then directed beneath the ink-jet cartridge 182, as the cartridge traverses the width of the paper. The printed sheet emerges from a paper exit slot 30** on the other side of the printer.

As the paper enters the casing 172 near the path of the ink-jet cartridge 182, a media sensor detects the entry of the leading edge 71 of the paper **235*a* into the casing 172**.

Figure 8:
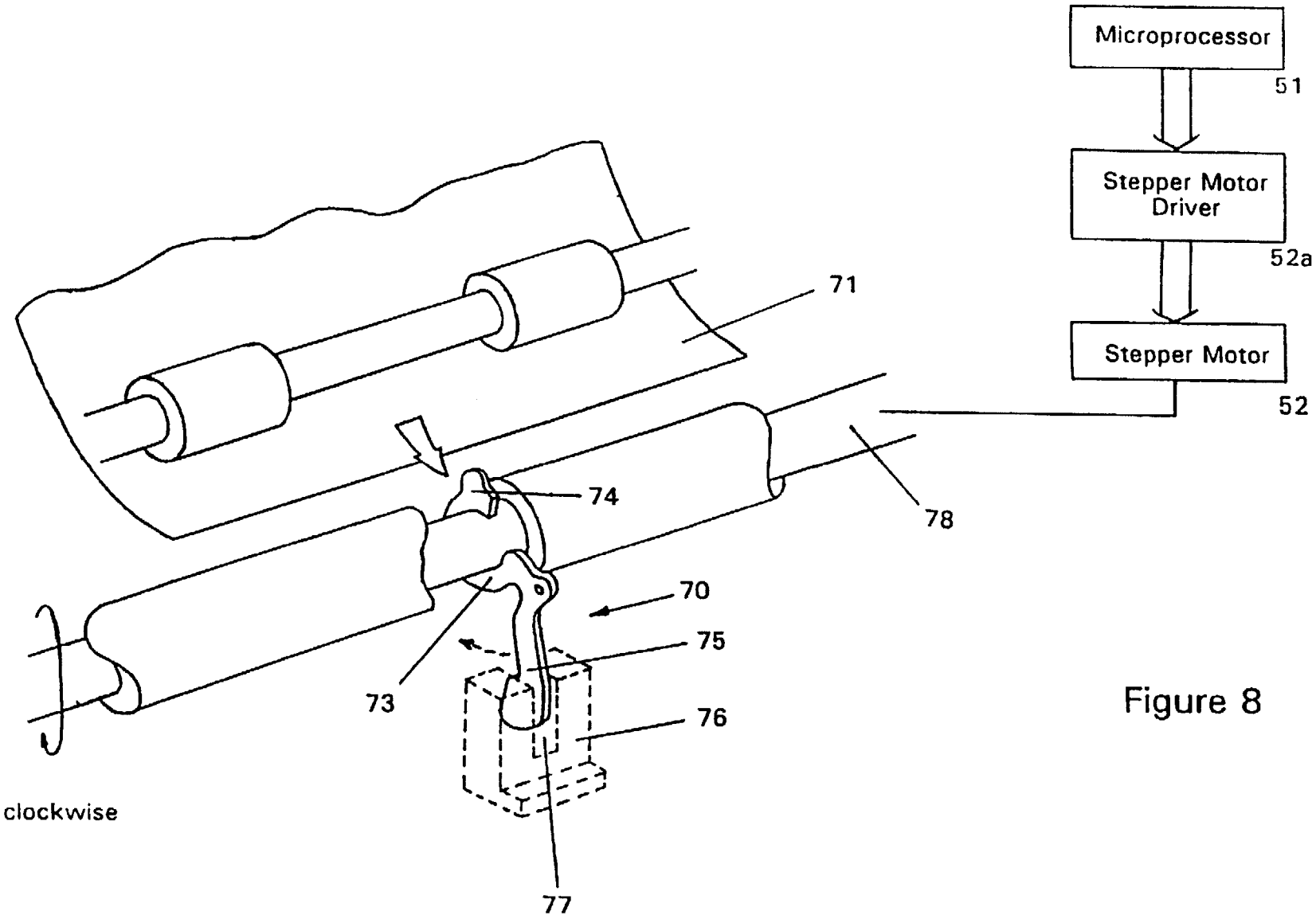
FIG. 8 is a schematic diagram of a media sensor used in the printer of FIG. 1.

Referring to FIG. 8, in the present embodiment, the media sensor is in the form of an optical-mechanical sensing mechanism 70. Part of the mechanism consists of a shaped collar member 73 that is hooked loosely about the axle of a driver roller 78 which is also driven by the stepper motor 52. This loose connection allows the collar member 73 to swivel independently about the axle of the drive roller 78. The collar member 73 swivels in a plane that is substantially normal to the axle of the drive roller. The upper portion of the collar member is provided with an upstanding tag 74, while the lower portion is provided with an elongated depending tag 75. Hence, the upstanding tag 74 and the depending tag 75 both swivel about the axle of the drive roller in tandem. The collar member is maintained in an equilibrium disposition (as illustrated in FIG. 8) by means of a spring (not shown) attached to depending tag 75. The spring resists any swiveling motion of the collar member in a clockwise direction (as indicated by the circular arrow in FIG. 8).

Another part of the optical-mechanical sensing mechanism 70 comprises an opto-coupler 76 (shown partially in outline) which includes a slot 77. A beam of light is directed from one end of the slot to the other, traveling across the slot 77. However, when the collar member is in the equilibrium position, as illustrated in FIG. 8, the depending tag 75 is positioned within the slot 77, so as to block the light path of the beam of light that is intended to shine from one side of the slot to the other.

The upstanding tag 74 of the sensing mechanism 70 is positioned in the path of the paper feed. As the leading edge 71 of the paper contacts the upstanding tag 74, the tag is urged forwardly so as to rotate clockwise around the axle of the drive roller. Since the depending tag 75 moves in tandem with the upstanding tag 74, the forward clockwise movement of the upstanding tag causes the depending tag 75 to move out of the way of the light path of the beam of light, A—A. The upstanding tag 74 remains forwardly urged by the paper as the paper advances along the paper feed path through the printer 10. This forward urging of the upstanding tag 74 effectively causes light to shine from one side of the slot 77 to the other to complete an optical light circuit contained within the opto-coupler 76. This causes the circuit to send an appropriate signal 50 to the micro-processor 51 indicating that the paper has been able to successfully enter the printer from the sheet feeder 12.

The invention, however, is not restricted to this particular form of media sensor in the form of the optical-mechanical sensing mechanism 70. Alternative media sensors, such as purely optical devices, including photosensors, or purely mechanical sensors, may be used to detect the entry of paper into the casing.

It is not essential that the detection be limited to the entry of paper into the casing. It is preferred that the sensor be able to detect that the printable media has been successfully grabbed by the pinch roller 230, or equivalent mechanism, to such an extent that the paper is ensured of reaching the printing mechanism of the printer. Hence, the actual position of the media sensor in the design of the printer may be varied, so long as the media sensor is able to perform the foregoing function.

The speed of rotation of the shaft 231 ("slew speed"), which is driven by the stepper motor 52, may be varied according to the instruction sent to the motor by a motor speed controller. In the present embodiment, the micro-processor 51 performs the function of the motor speed controller. The micro-processor 51 is controlled by a computer program which may be stored in the computer circuitry. However, it is within the scope of the invention for a variable speed motor to be controlled by some mechanical or other effective means, such as a host computer coupled to the printer. As another example, a form of media sensor might be used to selectively trigger a range of relays, each adapted to cause the stepper motor 52 to operate at a different speed. Hence, the motor speed controller used to control the stepper motor 52 need not be restricted to a micro-processor and computer program.

Initially, the stepper motor 52 is set at a high slew speed (measured in pulses per second, "p.p.s."), causing the pinch roller 230 to rotate at a high rotational rate. Preferably, this initial rotation rate should not be set at the absolute highest rate possible, since this would leave little margin for error, due to variation in the performance of commercially available stepper motors. In the present embodiment, the new stepper motor 52 has the ability to advance paper at a rate faster than 1,000 p.p.s. Nevertheless, it has been found that performance above 1,000 p.p.s. may be erratic with little margin for error, and so from a design viewpoint, 1,000 p.p.s. has been selected as an upper limit at which most new stepper motors are able to consistently advance the paper through the printer without stalling.

The stepper motor 52 first of all attempts to advance the paper through the printer 10 while running at the high initial speed of 1,000 p.p.s. The stepper motor rotates for a predetermined checking period, for example, in the range of 2,000 to 5,000 steps. In the present embodiment, the stepper motor rotates for 3,300 steps which is equivalent to about seventy revolutions of the axle of the stepper motor. In the stepper motor used in the embodiment, 1 step=7.5 degrees of rotation. However, this is a characteristic of the particular motor selected for the embodiment, and is not necessarily a constant equation for every motor. If the amount of torque generated by the stepper motor 52, running at a slew speed of 1,000 p.p.s., is sufficient to advance the paper, then the sensing mechanism 70 would be reasonably expected to detect the paper within this time period taken for the rotation of the 3,300 steps. If the sensing mechanism 70 detects that the paper has advanced successfully through the printer within this checking period, the motor is then set to run at this maximum slew speed of 1,000 p.p.s., and continues to do so until a sheet of paper cannot be advanced at this speed. Hence, the printer is able to function at this high rotational speed of 1,000 p.p.s., at least while the motor is relatively new, in contrast to earlier designs, which were limited to an intermediate speed, i.e. 500 p.p.s., for the entirety of their lifespan.

However, when the sensing mechanism 70 does not detect any paper entering the printer during the 3,300 step checking period, it could be due to the inability of the stepper motor 52 to provide sufficient torque when running at the maximum initial rotational speed of 1,000 p.p.s. Alternatively, the lack of detection of any paper could simply be due to the absence of paper in the sheet feeder 12.

It is preferable to test whether the paper feed failure is due to insufficient motor torque, or due to the fact that there is no paper in the sheet feeder. To perform this test, the micro-processor 51 instructs the stepper motor 52 to lower the rotational speed of the stepper motor to a lower level at which paper advancement would be certain to succeed, in this instance, a slew speed of 550 p.p.s. If the sensing mechanism 70 detects that paper advancement is successful at this low speed of 550 p.p.s., it is assumed that the stepper motor 52 was unable to provide sufficient torque when running initially at the higher speed of 1,000 p.p.s. This fact may be stored in non-volatile memory 60 of the circuitry. Consequently, when the next sheet of paper is to be printed, the micro-processor 51 instructs the stepper motor 52 to commence rotation at a lower initial speed of 900 p.p.s. rather than the maximum speed of 1,000 p.p.s. The same iterative sequence is performed. If the paper advances successfully at 900 p.p.s., then the printer 10 continues to advance paper at the speed of 900 p.p.s. until a further failure occurs. However, when the sensing mechanism 70 detects a failure to advance the paper at 900 p.p.s., the sensing mechanism provides an indication to the micro-processor 51, which in turn instructs the stepper motor 52 to drop once again to the lower level of 550 p.p.s. to ascertain the origin of the failure, as described above (no paper or failure to pick). If advancement is successful at 550 p.p.s., the printer attempts to advance the next sheet of paper at a sequentially lower speed, such as 850 p.p.s., and so forth.

In the present embodiment, the iterative sequence proceeds as described, according to the following sequence:

| Slew Speed | Torque Margin |
|---|---|
| 1,000 p.p.s. | 10% |
| 900 p.p.s. | 14% |
| 850 p.p.s. | 16% |
| 800 p.p.s. | 17% |
| 750 p.p.s. | 18% |
| 700 p.p.s. | 19% |
| 650 p.p.s. | 20% (end of iterative sequence). |
| 550 p.p.s. | 22% (test speed) |

The above figures have been ordered at intervals of 50 p.p.s., although the invention is not limited to the above sequence, increments or proportions, of values. For example, rather than 5% speed reduction steps, the reductions may be at 10%, 20% or other suitable intervals, depending upon the particular implementation.

In the above table, the rotational speed of the stepper motor 52 has been expressed in terms of the slew speed of the motor, measured in pulses per second (p.p.s.). The torque produced by the stepper motor 52 at a particular slew speed has been expressed in terms of torque margin, which is proportional to torque. The torque margin is a measure of the difference between the actual torque generated at the particular slew speed, and the torque at which the motor is expected to stall. Hence, when a stepper motor runs with a very small torque margin, there is a higher likelihood of stalling, as compared to when the motor runs with a higher torque margin.

In the illustrated embodiment, once the slew speed of the stepper motor 52 decreases to 650 p.p.s., the printer will no longer rely on the iterative sequence. Hence, if the stepper motor fails to advance paper when running at 650 p.p.s., then the printer will indicate that it is out of paper, and will not proceed with the printing job.

At any point in the iterative sequence of the embodiment, the prevailing speed at which the stepper motor 52 is set to run is stored preferably in non-volatile memory 60 in the circuitry of the printer 10. When the printer is turned off, this information in the nonvolatile memory 60 is retained. When the printer is turned on again, the iterative process starts with the stepper motor 52 set to run at the initial slew speed of 1,000 p.p.s. However, if failure this time occurs at the speed of 1,000 p.p.s., rather than lowering the speed to the next incremental level of 900 p.p.s., the speed of the stepper motor is lowered straight down to the speed value stored in the non-volatile memory 60.

There maybe instances where the performance of the motor or printer is modified or enhanced, for example, as a result of repairs or replacement with new parts. When such improvements have been made, for example in the present embodiment, the stepper motor 52 may no longer need to be slowed down to the lower operational speed that has been stored in non-volatile memory 60. Hence, when the enhanced printer is first turned on, the stepper motor 52 commences operation at the initial slew speed of 1,000 p.p.s. If no feed failures occur at 1,000 p.p.s. due to the enhancements, then the lower operational speed stored in the memory 60 is changed back to the upper value of 1,000 p.p.s. It is assumed that the conditions that had required the printer to operate at the lower speed no longer exist. In this manner, the printer using the iterative sequence of the embodiment is able to respond even to positive improvement in motor performance, as well as being able to compensate for negative degradation of motor performance over time.

It is important to note that the claimed invention in its broadest aspect is not limited to the iterative sequence described above. Although the stepper motor 52 in the embodiment is set initially at its optimum rotation speed and subsequently lowered progressively, the invention may use a variety of other sequences, particularly when the variable speed motor is capable of being controlled iteratively to optimize the performance of the motor at any point in time. As an example, the stepper motor 52 might be set initially at its lowest rotation speed, which may then be increased progressively with each subsequent sheet of paper, until the motor fails to advance the paper. Alternatively, the stepper motor 52 might be set to run initially at 1,000 p.p.s., with the speed of the stepper motor decreasing at each iterative step, without the intermediate test step of dropping to 550 p.p.s. to ascertain the origin of the feed failure. There are any number of possible iteration sequences that would allow the stepper motor to arrive at an optimum speed depending on the prevailing operational parameters.

An advantage of the embodiment is that at each point in the operational life of the printer 10, the stepper motor 52 is made to run the optimum speed at which the motor, at that point, is capable of functioning consistently without stalling. As an example, a new printer is able to advance paper initially at a speed of, say, 1,000 p.p.s. This may decrease gradually over the lifetime of the printer down to a rate of, say, 550 p.p.s. Hence, a printer incorporating the iterative control sequence of the embodiment would be able to take advantage of the high motor speed of 1,000 p.p.s., at least while the motor is new. This is in contrast to earlier printers which, for the entire operational life of the printer, are set to operate at a low constant speed of rotation of, say, 550 p.p.s. which is done to ensure that the motor will be capable of maintaining this lower rotational speed for the lifetime of the printer. Therefore, another advantage of the present invention is that the performance of the printer is optimized, at least during the early part of the printer's lifetime. As an example, it has been found that a new printer, constructed according to the embodiment, advanced paper almost twice as fast as compared to an earlier model of the printer that does not make use of the iterative control sequence of the embodiment.

Another advantage of the invention is that it permits the use of smaller motors in printing mechanisms. Since, according to this invention, it is possible to run the motor closer to its optimum capability, it is no longer necessary to use a larger motor set to run at medium capability. A smaller motor running close to its optimum speed would provide similar performance as a larger motor running at medium performance. The ability to use smaller motors allows for the design of lighter and more economical printers. Smaller motors also require less power, which is especially useful for the design of portable printers which may be powered by battery.

Furthermore, there are other factors, apart from the age of the motor, that may influence the ability of the stepper motor 52 to advance the paper. The thickness of the paper or printable media, and even ambient temperature, can influence the performance of the stepper motor 52. The iterative control sequence allows the stepper motor 52 to run at the optimum rotational speed suitable for the prevailing operational parameters; such as motor age, ambient conditions and/or the characteristics of the printable media.

Without this ability to iteratively vary the speed of the motor 52, the printer 10 would have to operate with the motor set to rotate at a constant speed. Since the stepper motors of earlier printers are conservatively set to run well below maximum performance, so that the motors will be able to perform for a longer operational lifetime, the optimum capability of stepper motors in these earlier printers was never utilized fully.

I claim:

1. A method of advancing printable media through a printing mechanism using a variable speed motor, comprising the steps of:

attempting to advance the media through the printing mechanism with the motor set to run at an initial speed;

detecting whether the motor is able to advance the media through the printing mechanism; and, whereupon detecting that the motor is unable to advance the media through the printing mechanism with the motor set at said initial speed, repeating the two steps of (i) varying the speed of said motor to run at a slower speed, and (ii) said step of detecting, until the speed is varied to a speed at which said step of detecting detects that the motor is able to advance the media through the printing mechanism.

2. A method according to claim 1 wherein said initial speed is proximate the highest speed at which the motor, when it is new, is able to consistently advance media through the printing mechanism without stalling.

3. A method according to claim 1 wherein, upon initially detecting that the motor is unable to advance the media through the printing mechanism and before repeating said two steps, the method further includes a step of lowering the speed of said motor to a low speed, below said different speed, at which low speed the motor is certain to be able to advance the media through the printing mechanism.

4. A method according to claim 1 wherein, before said step of detection, the method further includes a step of running the motor for a limited time period to provide an opportunity for any media to be advanced through the printing mechanism.

5. A method according to claim 1 wherein said initial speed is proximate the highest speed at which the motor, when it is new, is able to consistently advance media through the printing mechanism without stalling, and wherein, upon initially detecting that the motor is unable to advance the media through the printing mechanism and before repeating said two steps, the method further includes a step of lowering the speed of said motor to a low speed, below said different speed, at which low speed the motor is certain to be able to advance the media through the printing mechanism, and wherein, before said step of detection, the method further includes a step of running the motor for a limited time period to provide an opportunity for any media to be advanced through the printing mechanism.

6. A method according to claim 1 wherein each time the speed of the motor is varied, said speed decreases each time by a constant interval of speed.

7. A method according to claim 1 wherein said motor is a stepper motor.

8. A method according to claim 1 wherein the speed of said motor is varied by a micro-processor.

9. A method according to claim 1 wherein said initial speed is proximate the highest speed at which the motor, when it is new, is able to consistently advance media through the printing mechanism without stalling, and wherein, upon initially detecting that the motor is unable to advance the media through the printing mechanism and before repeating said two steps, the method further includes a step of lowering the speed of said motor to a low speed, below said different speed, at which low speed the motor is certain to be able to advance the media through the printing mechanism, and wherein, before said step of detection, the method further includes a step of running the motor for a limited time period to provide an opportunity for any media to be advanced through the printing mechanism and wherein each time the speed of the motor is varied, said speed decreases each time by a constant interval of speed, and wherein said motor is a stepper motor, the speed of which is varied by a microprocessor.

10. A printing mechanism having a variable speed motor adapted to advance printable media through the printing mechanism, comprising:

a media sensor for detecting whether the media is advancing through the printing mechanism; and a motor speed controller adapted to vary the speed of the motor in response to an indication from the media sensor;

wherein, upon receiving indication from the media sensor that the motor is unable to advance the media through the printing mechanism when the motor is set at a certain speed, said motor speed controller repeatedly incrementally lowers the speed of the motor until it reaches a speed at which the media sensor detects that the motor is able to advance the media through the printing mechanism.

11. A printing mechanism according to claim 10 wherein said media sensor comprises an optical-mechanical mechanism which, upon said mechanism engaging with the media, is able to indicate to said motor speed controller that the media is able to advance through the printing mechanism.

12. A printing mechanism according to claim 10 wherein the printing mechanism comprises an inkjet printer which further includes an inkjet printhead for printing images on the media.

13. A printing mechanism according to claim 11 wherein said media sensor comprises a photoelectric-sensor.

14. A printing mechanism according to claim 10 wherein said motor is a stepper motor.

15. A printing mechanism according to claim 10 wherein said motor speed controller comprises a micro-processor.

16. A printing mechanism according to claim 10 wherein said media sensor comprises an optical-mechanical mechanism which, upon said mechanism engaging with the media, is able to indicate to said motor speed controller that the media is able to advance through the printing mechanism, and wherein the printing mechanism comprises an inkjet printer which further includes an inkjet printhead for printing images on the media, said media sensor comprises a photoelectric-sensor, said motor is a stepper motor, and said motor speed controller comprises a micro-processor.

17. A media advance system for advancing a media sheet through a printing mechanism, said system comprising:

a motor for advancing a media sheet through the printing mechanism, said motor initially being set at an initial speed which is proximate the highest speed at which the motor, when it is new, is able to consistently advance media;

a media sensor for detecting whether the media sheet is advancing through the printing mechanism;

a non-volatile memory which stores a prevailing speed at which the motor was most recently able to advance a media sheet through the printing mechanism; and a motor speed controller adapted to vary the speed of the motor in response to an indication from the media sensor that the motor is unable to advance the media sheet through the printing mechanism with the motor set at a current speed;

wherein, upon receiving indication from the media sensor that the motor is unable to advance the media sheet through the printing mechanism with the motor is set at the current speed, said motor speed controller lowers the speed of the motor to the prevailing speed and thereafter incrementally lowers the speed of the motor until it reaches a speed at which the motor is able to advance the media sheet through the printing mechanism.

* * * * *